US005110114A

United States Patent [19]

Yamauchi et al.

[11] Patent Number: 5,110,114

[45] Date of Patent: May 5, 1992

[54] METHOD AND APPARATUS FOR MULTIPLE SHEET DETECTION

[75] Inventors: Makoto Yamauchi; Yoshiaki Kurata; Tadashi Ichinose, all of Ibaraki, Japan

[73] Assignee: Komori Corporation, Tokyo, Japan

[21] Appl. No.: 665,600

[22] Filed: Mar. 6, 1991

[30] Foreign Application Priority Data

Mar. 8, 1990 [JP] Japan ..... 54992

[51] Int. Cl.[5] ..... B65H 7/12

[52] U.S. Cl. ..... 271/262; 271/263

[58] Field of Search ..... 271/262, 263

[56] References Cited

U.S. PATENT DOCUMENTS 4,652,742 3/1987 Wauer et al. ..... 271/263 X 4,670,647 6/1987 Hubble, III. et al. ..... 271/263 X 4,761,002 8/1988 Reed et al. ..... 271/263 X

*Primary Examiner*—David H. Bollinger

*Attorney, Agent, or Firm*—Blakely, Sokoloff, Taylor & Zafman

[57] ABSTRACT

According to a method and apparatus for multiple sheet detection for performing ON/OFF control of a multiple sheet detection function for sheets on the basis of use/non-use information set by keys (8), sheet data is fetched (5, 201) from one sheet fed for the first time. It is determined (5, 202) on the basis of the fetched sheet data whether multiple sheet feeding of the sheets can be discriminated by the multiple sheet detection function. A use/non-use state is checked (5, 204) by the keys when multiple sheet feeding can be discriminated by the multiple sheet detection function. An alarm is generated (205) on the basis of a check result.

9 Claims, 3 Drawing Sheets

METHOD AND APPARATUS FOR MULTIPLE SHEET DETECTION

BACKGROUND OF THE INVENTION

The present invention relates to a method and apparatus for multiple sheet detection suitable for a sheet-fed press.

A multiple sheet detector is used to perform multiple sheet detection when sheets (paper) are supplied to a conventional sheet-fed press.

More specifically, when a sheet is to be supplied from a sheet feeder to a sheet-fed press (to be referred to as a printing press hereinafter), a leading edge of a sheet is brought into contact with a stopper called a front gauge arranged at the press-side distal end portion of a stack board, and then the sheet is fed to the printing press. In this case, in order to prevent simultaneous feeding of two or more sheets, a light-emitting element is arranged on the lower surface of the stack board near the front gauge, a through hole is formed at a predetermined portion of the stack board opposite to a light-emitting portion of the light-emitting element, and a light-receiving element is arranged on the upper surface of the feed board at a position opposite to this through hole. More specifically, light emitted from the light-emitting element is projected in a direction of thickness of a sheet to be fed, light transmitted through the sheet is received by the light-receiving element, and an output from the light-receiving element is converted into an electrical signal. An output level corresponding to a light amount represented by the electrical signal is compared with a predetermined discrimination level, thereby performing multiple sheet detection on the basis of a comparison result.

In such a multiple sheet detector, use or non-use of a multiple sheet detection function for sheets can be switched upon an operation using a switch or the like. More specifically, it is often desirable to perform printing without using the multiple sheet detection in accordance with the types of sheets and printing conditions. In order to cope with this need, the use or non-use of the multiple sheet detection can be switched.

In the conventional multiple sheet detector, however, when the multiple sheet detection function is set in a non-use state in previous printing, and an operator forgets to switch the function to the use state, the next operator may often forget to set the use state of the multiple sheet detection function in current printing.

When the operator forgets to set use of the multiple sheet detection function and printing is started, although multiple sheet feeding can be detected by the standard multiple sheet detection function, multiple sheet detection cannot be performed and multiple sheet feeding cannot be prevented.

When the operator forgets to set use of the multiple sheet detection function and printing is started, although multiple sheet feeding can be detected by the standard multiple sheet detection function, no alarm is generated in feeding of two or more sheets. Therefore, a countermeasure against multiple sheet feeding is delayed since the operator is not informed of this multiple sheet feeding.

Feeding of two or more sheets in the printing process is one of the major drawbacks. If this drawback occurs, normal printed products cannot be obtained, or printing is interrupted, thereby delaying the printing process. When printing continues while the operator does not notice that the multiple sheet detection function is not set, blank sheets may be mixed in the printed products, or a failure may occur in the printing press itself. This may lead to a claim for defective delivered products at a later date.

SUMMARY OF THE INVENTION

It is the principal object of the present invention to provide a multiple sheet detection apparatus for preventing two or more sheets from being fed due to setting errors.

It is another object of the present invention to provide a multiple sheet detection apparatus capable of coping with occurrence of feeding of two or more sheets, which is caused by setting errors.

It is still another object of the present invention to provide a multiple sheet detection apparatus for minimizing delay of the next process.

It is still another object of the present invention to provide a multiple sheet detection apparatus for reducing a load on an operator.

It is still another object of the present invention to provide a multiple sheet detection apparatus which can eliminate human setting errors.

In order to achieve the above objects of the present invention, there is provided a method for multiple sheet detection for performing ON/OFF control of a multiple sheet detection function for sheets on the basis of use/non-use information set by setting means, comprising the step of fetching sheet data from one sheet fed for the first time, the step of determining on the basis of the fetched sheet data whether multiple sheet feeding of the sheets can be discriminated by the multiple sheet detection function, the step of checking a use/non-use state by the setting means when multiple sheet feeding can be discriminated by the multiple sheet detection function, and the step of generating an alarm on the basis of a check result.

According to the present invention, there is also provided an apparatus for multiple sheet detection including means for setting use/non-use information of a multiple sheet detection function for sheets, and control means for performing ON/OFF control of the multiple sheet detection function on the basis of the use/non-use information set by the setting means, comprising means for fetching sheet data from one sheet fed for the first time, means for determining on the basis of the fetched sheet data whether multiple sheet feeding of the sheets can be discriminated by the multiple sheet detection function, means for checking a use/non-use state by the setting means when multiple sheet feeding can be discriminated by the multiple sheet detection function, and means for generating an alarm on the basis of a check result.

According to the present invention, it is determined whether feeding of two or more sheets can be discriminated by a standard multiple sheet detection function. If it is determined that such feeding can be detected by the standard multiple sheet detection function, use or non-use of the multiple sheet detection function is checked. If the multiple sheet detection function is set in the non-use state, an alarm is generated.

According to the present invention, it is determined whether feeding of two or more sheets can be discriminated by a standard multiple sheet detection function. If it is determined that such feeding can be detected by the standard multiple sheet detection function, use or non-use of the multiple sheet detection function is checked. If the multiple sheet detection function is set in the non-use state, an alarm is generated upon multiple sheet detection.

According to the present invention, it is determined whether feeding of two or more sheets can be discriminated by a standard multiple sheet detection function. If it is determined that such feeding can be detected by the standard multiple sheet detection function, the multiple sheet detection function is set in the use state. If it is determined that such feeding cannot be detected by the standard multiple sheet detection function, the multiple sheet detection function is set in the non-use state.

According to the present invention, when it is determined that multiple sheet detection can be performed by the standard multiple sheet detection function, if the multiple sheet feed function is not set in the use state, i.e., if the multiple sheet detection function is set in the non-use state, a setting omission of the multiple sheet detection function is automatically alarmed.

According to the present invention, when it is determined that multiple sheet detection can be performed by the standard multiple sheet detection function, if the multiple sheet feed function is not set in the use state, i.e., if the multiple sheet detection function is set in the non-use state, feeding of two or more sheets and a setting omission of the multiple sheet detection function are automatically alarmed upon multiple sheet detection.

According to the present invention, when it is determined that multiple sheet detection can be performed by the standard multiple sheet detection function, the multiple sheet feed function is automatically set in the use state. Otherwise, the multiple sheet detection function is automatically set in the non-use state.

DESCRIPTION OF THE PREFERRED EMBODIMENTS

A method and apparatus for multiple sheet detection according to the present invention will be described in detail below.

Figure 1:
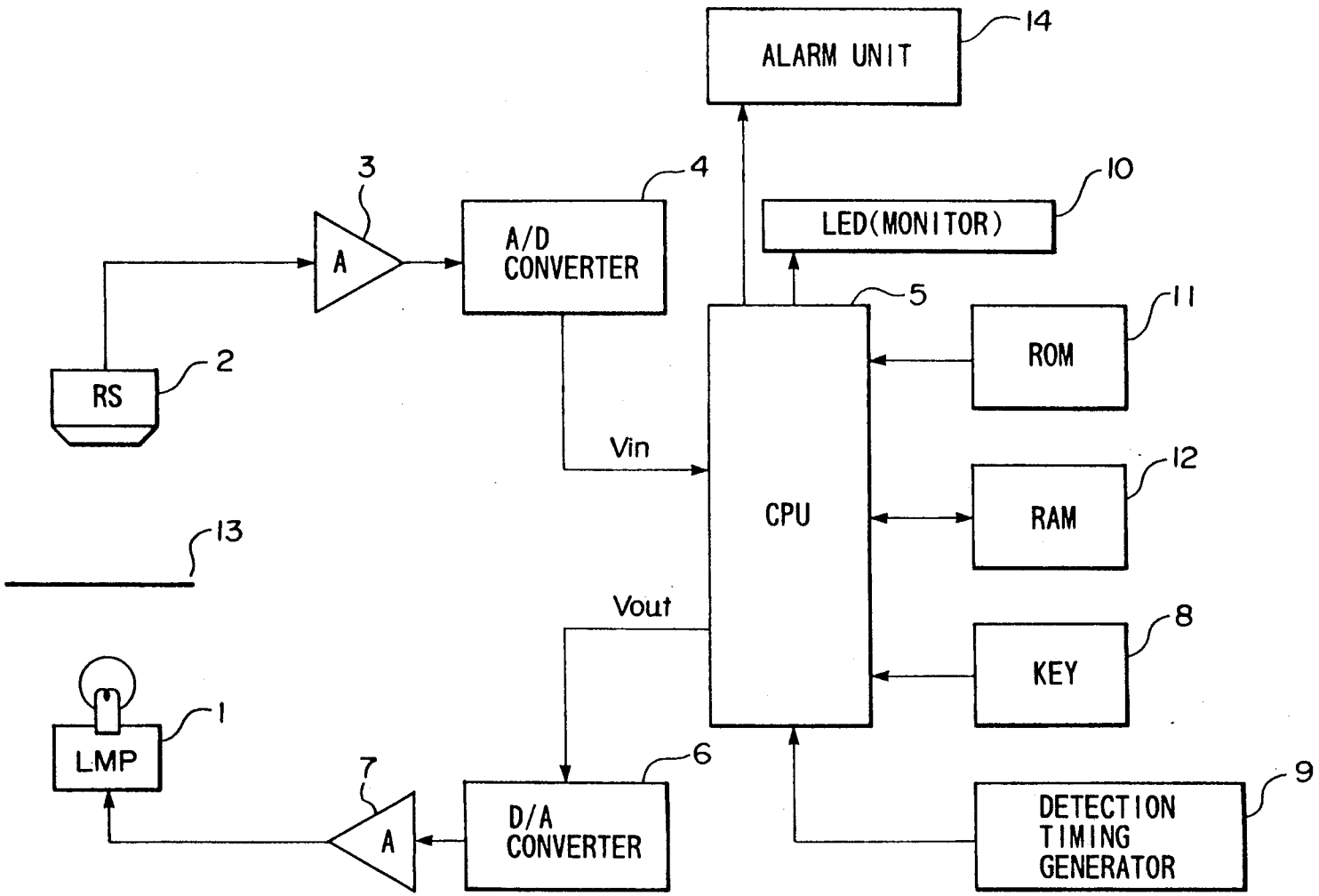
FIG. 1 is a block diagram showing an apparatus which employs the present invention.

FIG. 1 shows a system configuration of the apparatus which employs the present invention. Referring to FIG. 1, reference numeral 1 denotes a light-emitting element; 2, a light-receiving element; 3, an amplifier for amplifying an output electrical signal (analog signal) corresponding to a reception light amount output from the light-receiving element 2; 4, an A/D converter for converting the amplified electrical signal supplied through the amplifier 3 into a digital signal and for outputting the digital signal to a microprocessor (to be referred to as a CPU) 5 as an output level $V_{in}$; 6, a D/A converter for converting a control level (digital signal) $V_{out}$ output from the CPU 5 into an analog signal; and 7, an amplifier for amplifying the analog signal output from the D/A converter 6 into a power signal and for supplying the power signal to the light-emitting element 1.

The CPU 5 is connected to keys 8 with which an operator inputs commands, a detection timing generator 9 for generating a sheet detection timing, a monitor 10 for informing the operator of processing information of the CPU 5, and an alarm unit 14 for alarming a setting omission of the multiple sheet detection function. The CPU 5, a ROM 11 for storing programs for operating the CPU 5, and a RAM 12 for performing storage and editing of various types of information constitute a central processing section.

The light-emitting element 1 and the light-receiving element 2 are located at the front gauge of the stack board of a printing press (not shown) to interpose a sheet 13 therebetween, as described in the prior art.

Figure 2:
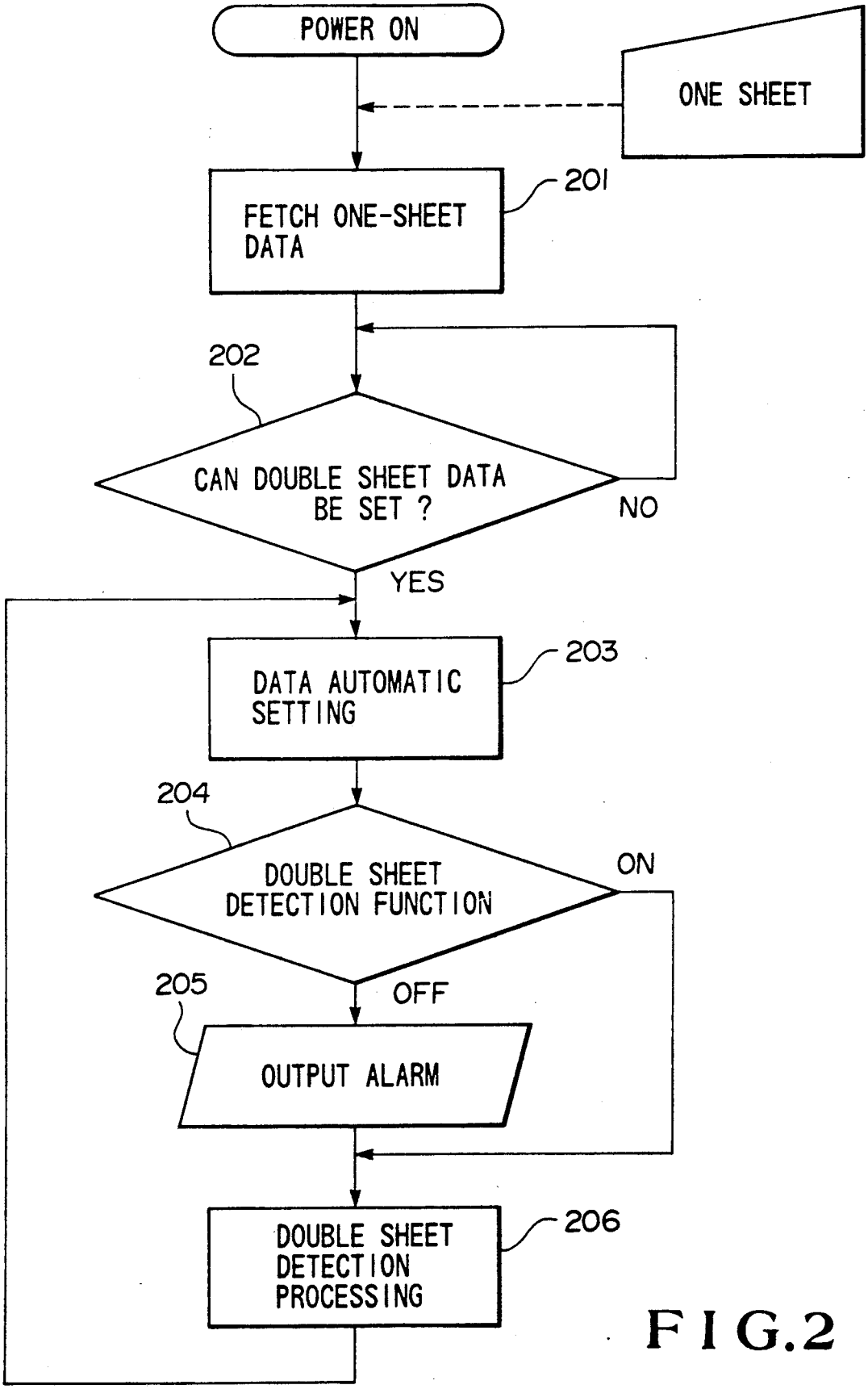
FIG. 2 is a flow chart showing CPU processing of this apparatus according to an embodiment of the present invention.

FIG. 2 shows the operation of the CPU 5 according to the first embodiment of the present invention. Processing operations will be described with reference to the flow chart of FIG. 2.

Upon the power ON operation, one sheet 13 is fed to the front gauge and is transferred to a portion between the light-emitting element 1 and the light-receiving element 2. When a "data fetch command" is supplied through the keys 8 or the detection timing generator 9, the CPU 5 fetches the input data representing the type and quality of paper (step 201). On the basis of the fetched data, arithmetic processing is performed to obtain reference data (double sheet data) for performing multiple sheet detection (to be referred to as a double sheet detection hereinafter) so as to determine whether the double sheet data can be set (step 202). More specifically, it is determined in step 202 whether double sheet detection of the sheets 13 can be performed by the standard double sheet detection function. If the intensity of received light transmitted through the single sheet 13 is in a predetermined range, then it is determined that double sheet detection can be performed. Otherwise, if the received light is outside of the predetermined range, then it is determined that double sheet detection cannot be performed. If YES in step 202, i.e., if it is determined that double sheet data can be set, the resultant double sheet data is automatically set (step 203). Fetching of data representing the type and quality of paper in step 201 and arithmetic processing of double sheet data in step 202 corresponds to an operation wherein "an optimal value $V_{od}$ of the control level $V_{out}$ and an optimal value $V_L$ of the discrimination level are obtained in correspondence with the paper quality on the basis of the output level $V_{in}$ obtained by using the control level $V_{out}$ as a defined level value $V_{os}$", as disclosed in Japanese Patent Application No. 63-333506 filed by the present applicant on Dec. 29, 1988. The Japanese application corresponds to claims 1–4 and FIGS. 1–5 and the discussions relating thereto contained in U.S. patent application Ser. No. 538,023, filed on Jun. 13, 1990. Accordingly, said corresponding portion of said U.S. patent application is incorporated herein by reference.

After the double sheet data is automatically set in step 203, then in step 204 the state of the switch for setting the use or non-use state of the multiple sheet detection means is checked. set in step 203, use or non-use of the sheet detection function is checked (step 204). The use or non-use of the double sheet detection function is supplied as a command to the CPU 5 through the keys 8 by the operator. If the double sheet detection function is set in the use state, i.e., in an ON state, normal double sheet detection processing is performed on the basis of the double sheet data automatically set in step 203 (step 206). To the contrary, when the double sheet detection function is set in the non-use state, i.e., in an OFF state, the alarm unit 14 is operated to alarm a setting omission of the double sheet detection function (step 205).

According to the multiple sheet detection apparatus of this embodiment, when the data representing the type and quality of paper of the sheets 13 are fetched, and it is determined that a multiple sheet state can be discriminated by the standard multiple sheet detection function, if the double sheet detection function is not set in the ON state, i.e., if the double sheet detection function is set in the OFF state, a setting omission of the double sheet detection function is automatically alarmed to the operator. Therefore, simultaneous feeding of two sheets can be prevented in advance, a delay in the printing process caused by an operator error can be minimized, and claims for defective delivered products can be eliminated.

Figure 3:
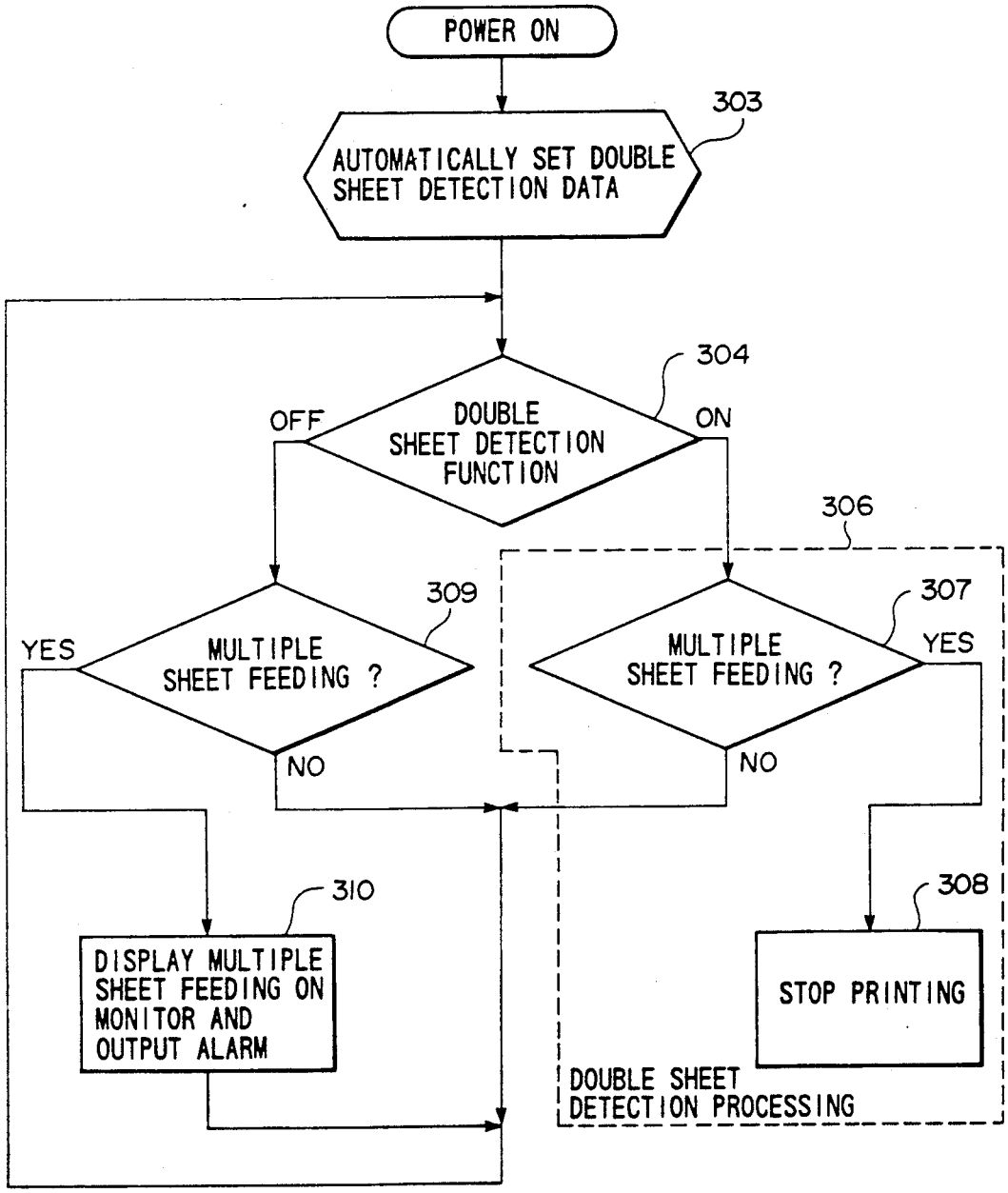
FIG. 3 is a flow chart showing CPU processing of this apparatus according to another embodiment of the present invention.

FIG. 3 shows processing of the CPU 5 according to another embodiment of the present invention. In this case, one sheet 13 is fed to a portion between the light-emitting element 1 and a light-receiving element the upon the power ON operation. When a "data fetch command" is input through the keys 8 or the detection timing generator 9, the CPU 5 fetches the data representing the type and quality of the sheet 13. Arithmetic operation is performed to obtain double sheet data on the basis of the fetched data to determine whether the double sheet data can be set. More specifically, it is determined whether a double sheet state of the sheets 13 can be discriminated by the standard double sheet detection function. If YES, the obtained double sheet data is automatically set (step 303).

When the double sheet data is automatically set in step 303, use or non-use of the double sheet detection function is checked (step 304). The check of the use or non-use of the double sheet detection function is repeated during feeding of each sheet 13. If the double sheet detection function is set in the ON state, the flow advances to double sheet detection processing (step 306) to check the current paper feed state (step 307). If double sheet feeding is detected, the flow advances to step 308 to stop printing by disengagement of cylinders. The double paper feed state is displayed on the monitor 10 to inform it to the operator. To the contrary, when the double sheet detection is set in the OFF state, the basic function of double sheet detection is utilized to check the current paper feed state (step 309). If a double sheet feed state is detected, the flow advances to step 310. The double sheet feed state is displayed on the monitor 10. At the same time, the setting omission of the double sheet detection function is alarmed by operating the alarm unit 14.

In the double paper detection apparatus of this embodiment, the data representing the type and quality of the sheet 13 is fetched. When it is determined that double sheet feeding can be discriminated by the standard double sheet detection function, and when the double sheet detection function is not set in the ON state, i.e., when the double sheet detection function is set in the OFF state, double sheet feeding and the setting omission of the double sheet detection function can be automatically alarmed to the operator upon double sheet detection using the basic function of double sheet detection. Double sheet feeding and the setting omission of the double sheet detection function can be simultaneously and immediately corrected. Smooth printing and a decrease in load of the operator can be achieved. A delay in printing process caused by the operator errors can be suppressed, and claims for defective delivered products can also be eliminated.

In each embodiment described above, whether double sheet data can be set is automatically determined. For this reason, as still another embodiment, if a sheet allowing setting of double sheet data is used, the double sheet detection function can be automatically set in the ON state. Otherwise, the double sheet detection function can be automatically set in the OFF state. The operator can be free from jobs associated with setting of the double sheet detection function. More specifically, use or non-use of the multiple sheet detection function need not be manually set at the time of paper feeding. As a result, an omission of the multiple sheet detection function caused by human setting errors can be eliminated.

In each embodiment described above, multiple sheet detection is performed for the sheets to be fed to a printing press. However, the present invention is applicable to various types of apparatuses which require multiple sheet detection.

According to the present invention, as has been described above, when it is determined that double sheet feeding can be detected by the standard multiple sheet detection function, and when the multiple sheet detection function is not set in the use state, i.e., the multiple sheet detection function is set in the non-use state, a setting omission of the multiple sheet detection function is automatically alarmed. Multiple sheet feeding can be prevented, a delay in printing process caused by operator errors can be minimized, and claims for defective delivered products can be eliminated.

According to the present invention, as has been described above, when it is determined that double sheet feeding can be detected by the standard multiple sheet detection function, and when the multiple sheet detection function is not set in the use state, i.e., the multiple sheet detection function is set in the non-use state, multiple sheet feeding and a setting omission of the multiple sheet detection function are automatically alarmed to the operator upon multiple sheet detection. Multiple sheet feeding and the setting omission of the multiple sheet detection function can be simultaneously and immediately corrected, and smooth printing and a decrease in load of the operator can be achieved. A delay in printing process caused by operator errors for setting the multiple sheet detection function can be minimized, and claims for defective delivered products can be eliminated.

According to the present invention, when it is determined that multiple sheet feeding can be detected by the standard multiple sheet detection function, the multiple sheet detection function is automatically set in the use state. Otherwise, the multiple sheet detection function is automatically set in the non-use state. The use or non-use of the multiple sheet detection function need not be manually changed, and a setting omission of the multiple sheet detection function which is caused by a human error can be eliminated.

What is claimed is:

1. A method of multiple sheet detection for performing ON/OFF control of a multiple sheet detection means for detecting the presence of multiple sheets on the basis of a use/non-use state set by a setting means, said use/non-use state indicating whether said multiple sheet detections means is in operation or not, said method comprising:

the step of fetching sheet data from one sheet fed for the first time;

the step of determining on the basis of the fetched sheet data whether multiple sheet feeding of the sheets can be discriminated by the multiple sheet detection means;

the step of checking the use/non-use state of said multiple sheet detection means by said setting means when multiple sheet feeding can be discriminated by the multiple sheet detection means; and the step of generating an alarm on the basis of a check result of the checking step, wherein the step of generating the alarm comprises the step of immediately generating the alarm when the check result represents a non-use state of said multiple sheet detection means.

2. A method according to claim 1, wherein the step of determining comprises the step of calculating reference data on the basis of the fetched sheet data and discriminating on the basis of the reference data whether multiple sheet feeding can be discriminated.

3. A method according to claim 1, wherein the sheet data is at least one of a type of paper and paper quality.

4. A method of multiple sheet detection for performing ON/OFF control of a multiple sheet detection means for detecting the presence of multiple sheets on the basis of a use/non-use state set by a setting means, said use/non-use state indicating whether said multiple sheet detections means is in operation or not, said method comprising:

the step of fetching sheet data from one sheet fed for the first time;

the step of determining on the basis of the fetched sheet data whether multiple sheet feeding of the sheets can be discriminated by the multiple sheet detection means;

the step of checking the use/non-use state of said multiple sheet detection means by said setting means when multiple sheet feeding can be discriminated by the multiple sheet detection means; and the step of generating an alarm on the basis of a check result of the checking step, wherein the step of generating the alarm comprises the step of generating the alarm when the check result represents a non-use state of said multiple sheet detection means and multiple sheet feeding is detected.

5. A method for multiple sheet detection for performing ON/OFF control of a multiple sheet detection means for detecting the presence of multiple sheets on the basis of a use/non-use state set by a setting means, said use/non-use state indicating whether said multiple sheet detections means is in operation or not, said method comprising:

the step of fetching sheet data from one sheet fed for the first time;

the step of determining on the basis of the fetched sheet data whether multiple sheet feeding of the sheets can be discriminated by the multiple sheet detection means; and the step of automatically setting the use/non-use state of the multiple sheet detection means in said setting means on the basis of a determination result of the determining step.

6. An apparatus for multiple sheet detection including means for setting a use/non-use state of a multiple sheet detection means for detecting the presence of multiple sheets, and control means for performing ON/OFF control of the multiple sheet detection means on the basis of a use/non-use state set by said setting means, said use/non-use state indicating whether said multiple sheet detection means is in operation or not, said apparatus comprising:

means for fetching sheet data from one sheet fed for the first time;

means for determining on the basis of the fetched sheet data whether multiple sheet feeding of the sheets can be discriminated by the multiple sheet detection means;

means for checking the use/non-use state of said multiple sheet detection means by said setting means when multiple sheet feeding can be discriminated by the multiple sheet detection means; and means for generating an alarm on the basis of a check result of the checking step, wherein said means for generating the alarm immediately generates the alarm when the check result represents a non-use state of said multiple sheet detection means.

7. An apparatus according to claim 6, wherein said means for determining calculates reference data on the basis of the fetched sheet data and discriminates on the basis of the reference data whether multiple sheet feeding can be discriminated.

8. An apparatus according to claim 7, further comprising automatic setting means for automatically setting the calculated reference data, and wherein said control means controls the multiple sheet detection means using the automatically set reference data.

9. An apparatus for multiple sheet detection including means for setting a use/non-use state of a multiple sheet detection means for detecting the presence of multiple sheets, and control means for performing ON/OFF control of the multiple sheet detection means on the basis of a use/non-use state set by said setting means, said use/non-use state indicating whether said multiple sheet detection means is in operation or not, said apparatus comprising:

means for fetching sheet data from one sheet fed for the first time;

means for determining on the basis of the fetched sheet data whether multiple sheet feeding of the sheets can be discriminated by the multiple sheet detection means;

means for checking the use/non-use state of said multiple sheet detection means by said setting means when multiple sheet feeding can be discriminated by the multiple sheet detection means; and means for generating an alarm on the basis of a check result of the checking step, wherein said means for generating the alarm generates the alarm when the check result represents a non-use state of said multiple sheet detection means and multiple sheet feeding is detected.

* * * * *

UNITED STATES PATENT AND TRADEMARK OFFICE

CERTIFICATE OF CORRECTION

PATENT NO. : 5,110,114

DATED : May 5, 1992

INVENTOR(S) : Yamauhi et al.

It is certified that error appears in the above-identified patent and that said Letters Patent is hereby corrected as shown below:

In column 4 at lines 60-61 delete "set in step 203, use or non-use of the sheet detection function is checked (step 204).";

In claim 1 in column 6 at line 62 change "method of" to --method for--;

In claim 4 in column 7 at line 24 change "method of" to --method for--.

Signed and Sealed this

Nineteenth Day of September, 1995

*Attest:*

Bruce Lehman

BRUCE LEHMAN

*Attesting Officer*

*Commissioner of Patents and Trademarks*